United States Patent [19]

Kelley

[11] 4,169,357

[45] Oct. 2, 1979

[54] REFRIGERATOR AND FREEZER MONITORING DEVICE

[76] Inventor: Joseph B. Kelley, 211 Sycamore Ave., Moundsville, W. Va. 26041

[21] Appl. No.: 901,514

[22] Filed: May 1, 1978

Related U.S. Application Data

[63] Continuation-in-part of Ser. No. 759,108, Jan. 13, 1977, abandoned.

[51] Int. Cl.[2] ..... F25B 49/00

[52] U.S. Cl. ..... 62/126; 165/11; 236/94

[58] Field of Search ..... 62/129, 126; 236/94; 165/11; 340/248 B

[56] References Cited

U.S. PATENT DOCUMENTS

| | | | |
|---|---|---|---|
| 2,439,331 | 4/1948 | Bean | 62/129 X |
| 2,690,550 | 9/1954 | Coonradt et al. | 340/248 B |
| 3,100,383 | 8/1963 | Christman | 62/129 X |
| 3,105,362 | 10/1963 | Gould | 62/126 |
| 3,260,006 | 7/1966 | Johnson | 62/126 |
| 3,516,860 | 5/1970 | Foster et al. | 62/126 |

*Primary Examiner*—William E. Wayner
*Attorney, Agent, or Firm*—Daniel Jay Tick

[57] ABSTRACT

A temperature-sensitive switch in a refrigerator or freezer, separate from the refrigeration and freezer equipment, remains open when the temperature is below a predetermined level and closes when the temperature rises above the predetermined level. A visible alarm and an audible alarm are provided outside the refrigerator and freezer at a commercial power source wall-type outlet. A battery is electrically connected to the visible and audible alarms via the temperature-sensitive switch whereby when the temperature in the refrigerator or freezer rises above the predetermined level, the alarms are actuated.

1 Claim, 3 Drawing Figures

REFRIGERATOR AND FREEZER MONITORING DEVICE

BACKGROUND OF THE INVENTION

This is a continuation-in-part of application Ser. No. 759,108, filed Jan. 13, 1977 for Refrigerator and Freezer Monitoring Device, now abandoned.

The present invention relates to a refrigerator and freezer monitoring device. More particularly, the invention relates to a refrigerator and freezer monitoring device for indicating when electrical energy is supplied thereto and for warning when the temperature rises above a predetermined level.

Objects of the invention are to provide a refrigerator and freezer monitoring device of simple structure, which is inexpensive in manufacture, installed with facility and convenience in new and existing refrigerators and freezers, and functions efficiently, effectively and reliably to warn when the temperature rises above a predetermined level.

BRIEF SUMMARY OF THE INVENTION

In accordance with the invention, a refrigerator and freezer monitoring device indicates when electrical energy is supplied thereto and for warning when the temperature rises above a predetermined level. The refrigerator and freezer are powered by a commercial power source via a wall-type outlet. The refrigerator and freezer monitoring device comprises a temperature-sensitive switch in a refrigerator and freezer, separate from the refrigeration and freezer equipment. The switch remains open when the temperature is below a predetermined level and closes when the temperature rises above said predetermined level. A visible alarm is provided outside and separate from the refrigerator and freezer at the wall-type outlet. An audible alarm is provided outside and separate from the refrigerator and freezer at the wall-type outlet. A battery is electrically connected to the visible alarm and the audible alarm via the temperature-sensitive switch whereby when the temperature in the refrigerator and freezer rises above the predetermined level the visible and audible alarm means are actuated. A power switch remains closed when the commercial power source provides the required power and opens when the commercial power source fails. A power indicating lamp at the wall-type outlet is electrically connected to the commercial power source via the power switch whereby the power lamp is energized as long as sufficient power is provided by the commercial power source.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
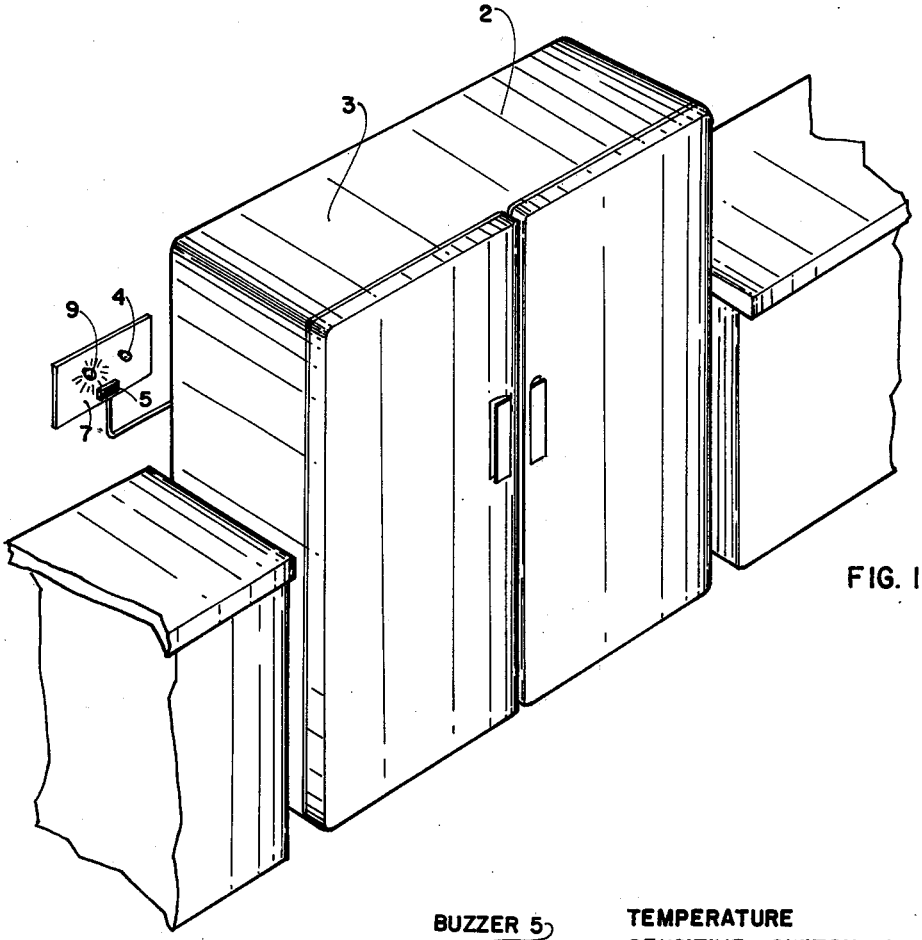
FIG. 1 is a perspective view of a refrigerator and freezer combination and the alarms of the monitoring device of the invention.

The refrigerator and freezer monitoring device of the invention indicates when electrical energy is supplied thereto and warns when the temperature in the refrigerator or freezer rises above a predetermined level. This results in a saving of the food in the refrigerator or freezer and a saving of electrical energy, which would otherwise be expended fruitlessly, if the mechanism of the refrigerator or freezer were malfunctioning.

The refrigerator and freezer monitoring device of the invention comprises a temperature-sensitive switch 1 (FIGS. 2 and 3) in a refrigerator 2 or freezer 3 (FIG. 1) separate from the refrigeration and freezer equipment of said refrigerator and freezer. The temperature-sensitive switch 1 may comprise any suitable temperature-sensitive switch such as a thermocouple. The temperature-sensitive switch 1 remains open when the temperature in the refrigerator or freezer is below a predetermined level and closes when the temperature rises above said predetermined level. The predetermined temperature level for the refrigerator is preferably between 35° F. and 45° F. and the predetermined temperature level for the freezer is between 0° F. and 10° F.

A visible alarm such as, for example, a red lamp 4 (FIGS. 1 to 3), is provided outside, and separate from, the refrigerator and freezer 2 and 3 at the wall-type outlet 7 of the commercial power source which powers said refrigerator and said freezer.

An audible alarm 5 of any suitable type such as, for example, a buzzer (FIGS. 1 to 3), is provided outside, and separate from, the refrigerator and freezer 2 and 3 at the wall-type outlet 7.

Figure 3:
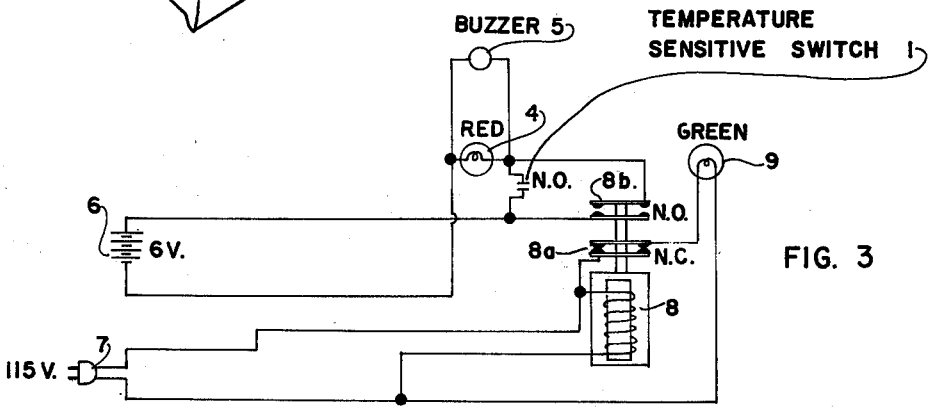
FIG. 3 is a circuit diagram of another embodiment of the refrigerator and freezer monitoring device of the invention.
Figure 2:
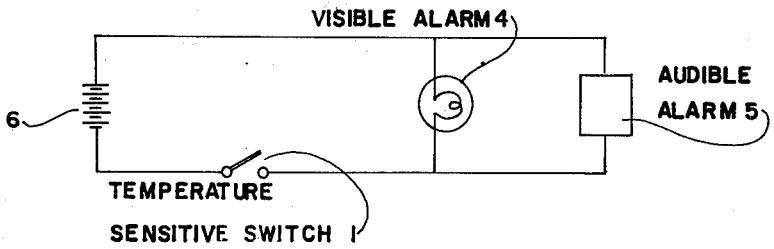
FIG. 2 is a circuit diagram of the refrigerator and freezer monitoring device of the invention.

A battery 6 (FIGS. 2 and 3) is electrically connected to the visible alarm 4 and the audible alarm 5 via the temperature-sensitive switch 1, as shown in FIGS. 2 and 3. Thus, when the temperature in the refrigerator or freezer rises above the predetermined level, the visible and audible alarms are actuated.

As shown in FIGS. 1 and 3, the refrigerator and freezer 2 and 3 are powered by a commercial power source supplied via a power line, the wall-type outlet 7 and an electrical connector plug 7. As shown in FIG. 3, a relay 8 has an energizing winding connected across the commercial power source. The relay energizing winding of the relay 8 controls relay contacts **8*a* and 8*b*. The relay contacts 8*a* are normally closed and the relay contacts 8*b*** are normally open.

The relay contacts **8*a* function as a power switch and remain closed as long as the commercial power source provides the required power, and open when the commercial power source fails. A power indicating green lamp 9 (FIGS. 1 and 3), which is preferably green, is electrically connected to the commercial power source at the wall-type outlet 7 via the power switch 8*a*, thus the green power lamp 9** is energized as long as power is provided by the commercial power source.

As shown in FIG. 3, the temperature-sensitive switch 1 remains open as long as the temperature in the refrigerator or freezer is at or below the predetermined level, thereby maintaining the alarm circuit open, so that the alarms 4 and 5 are deactivated. The relay contacts **8*b* are maintained open by the relay energizing winding as long as said winding is energized. Upon failure of the commercial power source, however, the relay contacts 8*b* close thereby closing the alarm circuit and actuating the alarms 4 and 5. Since the temperature-sensitive switch 1 is connected in parallel with the relay contacts 8***b*, when the temperature in the refrigerator or freezer rises above the predetermined level, the alarm circuit is closed, regardless of the condition of the relay contacts 8*b*, so that the alarms 4 and 5 are actuated.

While the invention has been described by means of specific examples and in specific embodiments, I do not wish to be limited thereto, for obvious modifications will occur to those skilled in the art without departing from the spirit and scope of the invention.

I claim:

1. A refrigerator and freezer monitoring device for indicating when electrical energy is supplied thereto and for warning when the temperature rises above a predetermined level, said refrigerator and freezer being powered by a commercial power source via a wall-type outlet, said refrigerator and freezer monitoring device comprising a temperature-sensitive switch in a refrigerator and freezer, separate from the refrigeration and freezer equipment said switch remaining open when the temperature is below a predetermined level and closing when the temperature rises above said predetermined level;

visible alarm means outside and separate from the refrigerator and freezer at the wall-type outlet;

audible alarm means outside and separate from the refrigerator and freezer at the wall-type outlet;

battery means electrically connected to the visible alarm means and the audible alarm means via the temperature-sensitive switch whereby when the temperature in the refrigerator and freezer rises above the predetermined level the visible and audible alarm means are actuated;

a power switch remaining closed when the commercial power source provides the required power and which opens when the commercial power source fails; and a power indicating lamp at the wall-type outlet and electrically connected to the commercial power source via the power switch whereby said power lamp is energized as long as sufficient power is provided by the commercial power source.

* * * * *